United States Patent [19]

Kier

[11] Patent Number: 4,564,887

[45] Date of Patent: Jan. 14, 1986

[54] LIGHTED NOTEPAPER TRAY

[76] Inventor: Mike Kier, 9134 Dillon, La Mesa, Calif. 92041

[21] Appl. No.: 516,540

[22] Filed: Jul. 25, 1983

[51] Int. Cl.[4] ..... F21V 33/00

[52] U.S. Cl. ..... 362/99; 362/802; 362/208

[58] Field of Search ..... 362/802, 118, 196, 99, 362/98, 109, 295, 208, 205; 200/60

[56] References Cited

U.S. PATENT DOCUMENTS 2,258,685 10/1941 Mattlatzki ..... 362/802 X
2,449,568 9/1948 Shriro et al. ..... 362/202 X
2,658,989 11/1953 Marschat ..... 362/802 X
3,697,737 10/1972 Levkoff ..... 362/99

FOREIGN PATENT DOCUMENTS 783978 4/1935 France ..... 362/98

*Primary Examiner*—Stephen C. Bentley
*Assistant Examiner*—John S. Maples
*Attorney, Agent, or Firm*—Ralph S. Branscomb

[57] ABSTRACT

A lighted tray is provided having a flat tray area, with a head end which mounts an illumination system. A laterally extended trough running along the crest of the head end defines a holding area for a ballpoint pen or the like, and a lever extending into the tray or pen-holding trough area is actuated by the removal of the pen to turn on the light to illuminate a notepad in the note tray.

3 Claims, 8 Drawing Figures

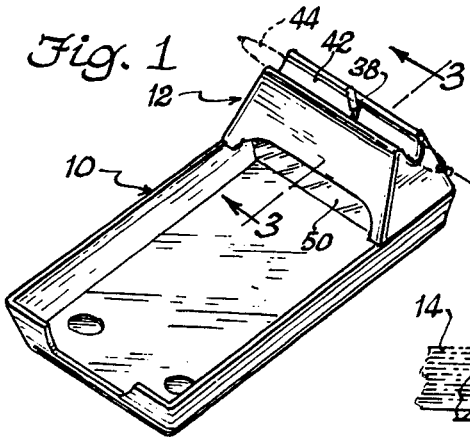
Fig. 1
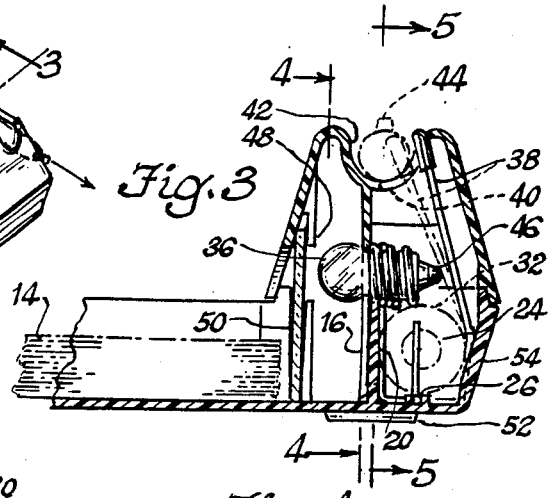
Fig. 3
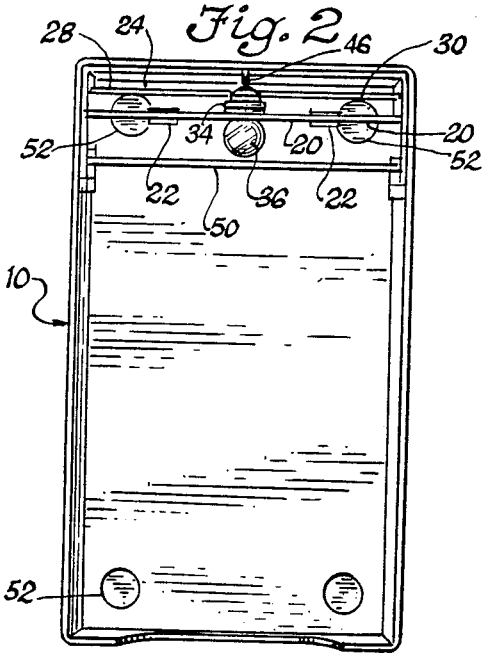
Fig. 2
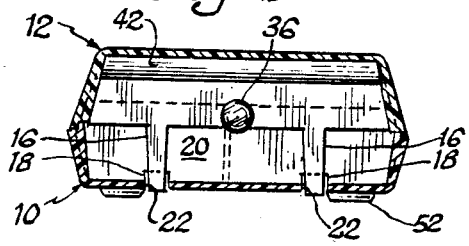
Fig. 4
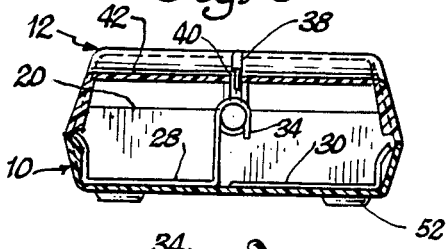
Fig. 5
Fig. 6
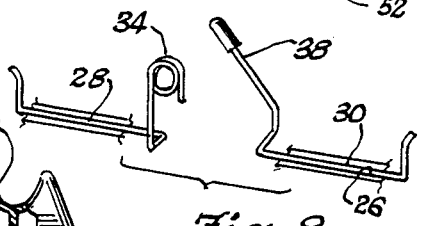
Fig. 8
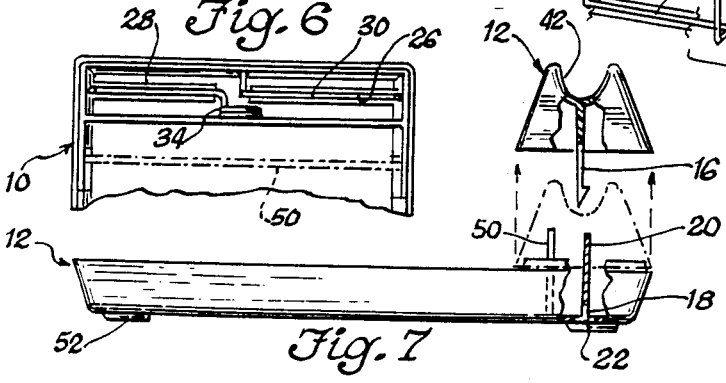
Fig. 7

LIGHTED NOTEPAPER TRAY

BACKGROUND OF THE INVENTION

The invention is in the field of lighted note trays, and more specifically note trays having self-contained illumination means.

There are many instances in modern life in which one needs to make notes, or take a message, in the dark. The most common instance would probably be when in bed, taking a phone message, or just jotting down a thought before it escapes, and not wanting to disturb anyone in the bedroom by turning on the light.

Travelers also frequently would have a need for a lighted note tray. Most airplanes have lights that more or less focus on one passenger's lap as opposed to another, however the light still bothers the pasesnger in the next seat. Moreover, many forms of transportation such as busses, trains, and even passenger cars, do not have focusable lights, or may not have personal lights at all.

Certain occupations by their nature generate a need for an illuminated note pad. For example, in police work, traffic tickets are written at all hours of the night. Currently, officers have a flashlight which they tuck between the right side of their chest and their upper right arm and direct at their ticketbook. This is clearly an awkward way of illuminating the ticketbook.

Waitresses, particularly cocktail waitresses, in dark bars, have a need for an illuminated tray to hold their customer checks, their order slips, and to make change. Pilots could use an illuminated tray to review flight plans in a dark cockpit. Undoubtedly, there are many other professions which would benefit by having available a small tray with a self-contained light illuminating the tray that could hold checks, traffic tickets, notepaper, or any other paper sheets for specialized purposes. However, no such device is available.

SUMMARY OF THE INVENTION

The present invention fulfills the above-stated need by providing a lighted notepaper tray having a front tray portion which will securely seat a pad of notepaper, and a head portion. The head portion defines a battery compartment, a flashlight bulb mount, and defines a pen-holding trough on top with a lever projecting into the trough which, when pressed out of the trough by the pen, keeps the circuit open between the lightbulb and the batteries, and when the pen is removed, the lever falls into the space previously occupies by the pen and in so doing, completes the circuit, illuminating the bulb.

The circuit is simplified to the extreme. The complete circuit, including connections to two batteries, a switch, and the above-referenced lever, actuated by removal of the pen, all consists of only two pieces of wire. The mounting of these two pieces of wire is also accomplished simply by ridges molded into the bottom of the battery compartment which are hot stamped around the wires.

The body of the device is molded in two pieces of plastic, one an elongated member that defines the tray, and the other being a cap portion which snaps over the head end of the tray to define the battery and bulb housing. When the two pieces are snapped together, a translucent window is captured between them such that light from the lightbulb is dispersed and the window acts as the illuminating element to more evenly light paper in the tray.

BRIEF DESCRIPTION OF THE DRAWINGS

FIG. 1 is a perspective view of the tray;

FIG. 2 is a top plan view of the tray with the head cap removed;

FIG. 3 is a section taken along line 3—3 of FIG. 1;

FIG. 4 is a section taken along line 4—4 of FIG. 3;

FIG. 5 is a section taken along line 5—5 of FIG. 3;

FIG. 6 is a top elevation view of the battery compartment with the batteries and lightbulb removed showing the wire element engagement;

FIG. 7 is a side elevation view of the tray with the head cap removed illustrated in a cutaway the engagement of the head cap with the lower tray; and FIG. 8 is a perspective illustrating the arrangement of the wire elements.

DETAILED DESCRIPTION OF THE PREFERRED EMBODIMENT

The body or frame of the tray is comprised of two molded plastic parts, the tray element 10 and the cap 12 which snaps onto the tray at the head end. As shown in several of the drawings, the cap 12 has a lower perimeter which is shaped to seat snugly on the mating perimeter of the tray element. The tray and the cap are held together to hold a pad 14 by virtue of two long, vertical detents 16 which extend down from the cap and snap into cutaway portions 18 molded into the bottom of the bulb-mounting panel 20. Access openings 22 are provided in the bottom of the tray element, both to permit the detents 16 to be pryed out of engagement to yield access to the battery compartment, and as a requirement in mold-making so that the cutaways 18 can be molded in place.

The cap 12 defines the front wall of the battery compartment 24. In the bottom of the battery compartment are molded ridges 26 between which are seated electrical elements 28 and 30. The ridges are hot stamped to melt them down around the elements. The ends of the wire elements 28 and 30 are bent upwardly as shown to make contact with the appropriately oriented batteries 32. The element 28 has a coil or loop 34 which engages the shank portion of the lightbulb 36 which is screwed into a hole in panel 20 and the counterpart end of the other wire 30 has an extended trigger 38. This trigger passes through the slotted opening 40 which lies in the area of the cap which is formed to define a continuous trough 42 to seat a ballpoint pen 44, or the equivalent.

The element 30 is shaped so that in its normal position it contacts the rear contact 46 of the lightbulb with the tip biased into the area of the trough 42. The wire that the contact is made of is resilient spring steel, and when the pen 44 lies in its trough 42, it is pushed away from contact with the lightbulb, so that the trigger enables the tray to have an automatic switching function, controlled by removing and replacing the pen. Additionally, when the pen is in place, the trigger acts as a catch to hold it in place.

At the front portion of the cap is defined a laterally extended lip 48. This lip engages the top edge of the translucent panel 50, the ends of which are secured by grooves molded into the sides of the tray element 10. The translucent and textured panel causes a fairly even level of illumination across a pad held in the tray. The bottom of the tray is provided with four molded feet 52 which could be covered with resilient non-slip material.

It can be seen that the instant tray holder is extremely simple in design, and especially the electrical connection system. The entire wiring and connection needed to turn off and on the light, and power the light from the batteries, consists of two wires, strategically bent and shaped, with no retaining means being necessary because of their shape and corresponding ridges and other structure in the molded body of the tray other than the hot stamped ridges. The biasing of the wire 30 into the trough 42 is a function of its shape and being backed at its lower portion by the rear wall portion 54 of the molded tray. No further biasing element is required with the simple wire acting as both a switch, and spring-loaded toggle, and a battery connection.

This simplicity of design leads to economy of manufacture, so that this needed and very useful lighted notepaper tray can be provided to the world at a price it can afford.

I claim:

1. A lighted notepaper holder comprising:

(a) a frame defining a notepaper tray;

(b) lighting means in said frame to illuminate paper in said tray;

(c) an open trough with outer regions defined by said frame;

(d) an electrical circuit for energizing said lighting means;

(e) a switch having a trigger biased into said trough which is displaced to open said circuit when a writing implement is placed in said trough, and closes said circuit when said implement is removed from said trough, said trigger also serving as a detent to removably hold a writing implement in place in said trough;

(f) said trigger being positioned to bear against an upper portion of a writing implement in said trough and having a downward component of force against said writing implement to act as a detent for same when in said trough;

(g) said circuit consisting of a single pair of conductive wires interconnecting a light bulb and two-terminal battery means and defining a switch therewith; and (i) one of said wires being coiled at one end to define a socket for said light bulb and at the other end defining a contact for one terminal of said battery means; and, (ii) the other of said wires having one end defining a contact for the other terminal of said battery means and the other end of said other wire being resilient and passing beyond, said being biased against, the terminal tip of said light bulb to define said on-off switch therewith, and terminating in said trigger such that movement of said trigger toward the outer regions of said trough as by inserting a pen in said trough opens said switch and de-energizes said bulb.

2. Structure according to claim 1 wherein both of said wires which comprise said circuit are rigid and at least slightly resilient, and said wires are hot stamped into engagement between ridges molded into the interior of said frame.

3. A lighted notepaper holder comprising:

(a) a frame defining a notepaper tray;

(b) said frame having a body, and a head end with a lower portion defining a battery compartment and a removable cap over said battery compartment;

(c) said cap housing illumination means powered by batteries in said battery compartment to illuminate paper in said tray;

(d) a removable translucent panel captured between said cap and lower portion of said head end defining said battery compartment, said panel being disposed between said lighting means and said notepaper tray to diffuse light from said lighting means onto said tray;

(e) the lower portion of said head end defining an upright panel having spaced cutaways therein and said removable cap has elongated depending detents which snap into engagement with said cutaways; and (f) said head portion defining access openings adjacent said cutaway portions to enable said detents to be snapped out of engagement with said cutaways externally of said frame to release said cap to provide battery access.

* * * * *